US009900683B2

(12) United States Patent
Stein (né Schulze) et al.

(10) Patent No.: US 9,900,683 B2
(45) Date of Patent: Feb. 20, 2018

(54) HEADPHONES

(71) Applicant: Sennheiser electronic GmbH & Co. KG, Wedemark (DE)

(72) Inventors: Elmar Stein (né Schulze), Hannover (DE); André Grandt, Wedemark (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 15/033,262

(22) PCT Filed: Oct. 31, 2014

(86) PCT No.: PCT/EP2014/073429

§ 371 (c)(1),
(2) Date: Apr. 29, 2016

(87) PCT Pub. No.: WO2015/063257

PCT Pub. Date: May 7, 2015

(65) Prior Publication Data

US 2016/0286320 A1 Sep. 29, 2016

(30) Foreign Application Priority Data

Oct. 31, 2013 (DE) ..... 10 2013 222 231

(51) Int. Cl.

| | |
|---|---|
| ***H04R 1/10*** | (2006.01) |
| ***H04R 7/04*** | (2006.01) |
| ***H04R 3/14*** | (2006.01) |
| ***H04R 9/06*** | (2006.01) |
| ***H04R 23/02*** | (2006.01) |
| *H04R 9/00* | (2006.01) |
| *H04R 17/00* | (2006.01) |

(52) U.S. Cl.

CPC ..... *H04R 1/1075* (2013.01); *H04R 1/1008* (2013.01); *H04R 3/14* (2013.01); *H04R 7/04* (2013.01); *H04R 9/06* (2013.01); *H04R 17/005* (2013.01); *H04R 23/02* (2013.01); *H04R 9/00* (2013.01); *H04R 17/00* (2013.01)

(58) Field of Classification Search

CPC ... H04R 1/24; H04R 1/26; H04R 1/28; H04R 1/1016; H04R 1/1075

See application file for complete search history.

(56) References Cited

U.S. PATENT DOCUMENTS

| | | | | |
|---|---|---|---|---|
| 3,894,198 A | | 7/1975 | Murayama et al. | |
| 3,943,304 A | * | 3/1976 | Piribauer | H04R 1/24 381/182 |
| 4,198,550 A | | 4/1980 | Matsuda et al. | |

(Continued)

FOREIGN PATENT DOCUMENTS

| | | |
|---|---|---|
| DE | 24 28 933 | 1/1975 |
| WO | WO 00/46786 | 8/2000 |

OTHER PUBLICATIONS

International Search Report for Application No. PCT/EP2014/073429 dated Feb. 6, 2015.

*Primary Examiner* — Matthew Eason
(74) *Attorney, Agent, or Firm* — Haug Partners LLP

(57) ABSTRACT

A headphone device comprising a surrounding ear pad and a sound generator which has a substantially rigid plate and a drive system for converting electrical signals into mechanical oscillations of the plate.

10 Claims, 2 Drawing Sheets

(56) References Cited

U.S. PATENT DOCUMENTS

| | | | | | |
|---|---|---|---|---|---|
| 4,418,248 | A * | 11/1983 | Mathis | H04R 1/26 | 381/190 |
| 4,447,678 | A | 5/1984 | Fidi | | |
| 5,430,803 | A * | 7/1995 | Kimura | H04R 1/1016 | 381/190 |
| 9,351,075 | B2 * | 5/2016 | Kunimoto | H04R 5/033 | |
| 2001/0026625 | A1 * | 10/2001 | Azima | H04R 7/045 | 381/152 |
| 2005/0008184 | A1 * | 1/2005 | Ito | H04M 1/05 | 381/370 |
| 2005/0197565 | A1 * | 9/2005 | Yagi | A61B 5/055 | 600/418 |
| 2010/0284558 | A1 * | 11/2010 | Kimura | A61F 11/14 | 381/333 |
| 2015/0326974 | A1 * | 11/2015 | Skubinski, III | H04R 7/04 | 381/309 |
| 2015/0373460 | A1 * | 12/2015 | Huang | H04R 1/02 | 381/190 |
| 2016/0119719 | A1 * | 4/2016 | Doshida | H04R 1/1075 | 381/190 |
| 2016/0119721 | A1 * | 4/2016 | Doshida | H04R 1/1075 | 381/190 |
| 2016/0127820 | A1 * | 5/2016 | Huang | H04R 1/10 | 381/380 |
| 2016/0277823 | A1 * | 9/2016 | Huang | H04R 1/1016 | |
| 2017/0180863 | A1 * | 6/2017 | Biggs | H04R 5/033 | |

* cited by examiner

HEADPHONES

The present application claims priority from International Patent Application No. PCT/EP2014/073429 filed on Oct. 31, 2014, which claims priority from German Patent Application No. 10 2013 222 231.9 filed on Oct. 31, 2013, the disclosures of which are incorporated herein by reference in their entirety.

FIELD OF THE INVENTION

It is noted that citation or identification of any document in this application is not an admission that such document is available as prior art to the present invention.

The present invention concerns a headphone device, in particular a headphone or earphone.

Earphones or headphones have long been known and typically have a peripherally extending ear pad and a voice coil coupled to a diaphragm, the voice coil being driven by a magnet system.

In the German application from which priority is claimed the German Patent and Trade Mark Office searched the following documents: U.S. Pat. Nos. 4,198,550, 3,894,198, 4,447,678 and WO 00/46786 A2.

SUMMARY OF THE INVENTION

An object of the present invention is to provide an improved headphone device which is of a simpler structure.

Thus there is provided a headphone device having a surrounding ear pad and a sound generator which has a substantially rigid plate and a drive system for converting electrical signals into mechanical oscillations of the (rigid) plate.

In an aspect of the present invention there is provided a flexible portion between the ear pad and the (rigid) plate. The flexible portion can provide for decoupling between the plate and the ear pad so that the emission characteristic of the plate can be improved.

In a further aspect of the present invention there is provided a piezoelectric film on one side of the plate for exciting the plate. Thus, in addition to the drive system which for example can be provided in the ear pad, there is provided a further possible option for exciting the plate. In that way it is possible to implement a 2-way transducer.

In a further aspect of the present invention the drive system has a magnet system and a voice coil, the voice coil being coupled to the plate.

In a further aspect of the present invention the drive system is in the form of a capacitive drive system.

In a further aspect of the present invention there is provided a frequency crossover for separating the input audio signals into higher-frequency or lower-frequency signals. The higher-frequency signals are fed to the piezoelectric film and the lower-frequency signals are fed to the drive system so that the higher-frequency signals are transmitted to the plate by way of the piezoelectric film and the lower-frequency signals are transmitted to the plate by way of the drive system. The invention concerns a notion of providing a headphone device having a surrounding ear pad and a sound generator. The sound generator has a substantially rigid plate and a drive system for converting electrical signals into mechanical oscillations of the plate. The drive system is provided in the ear pad or integrated therein. The ear pad is connected directly or indirectly to the plate.

In an aspect of the present invention provided between the ear pad and the plate is an at least partially peripherally extending portion which is highly flexible or very flexible so that mobility of the plate can be increased.

In a further aspect of the present invention provided on a first side of the plate (which is towards the ear pad) is a piezoelectric film adapted to reproduce higher frequencies.

In a further aspect of the present invention the cables for the magnet system and the like are laid in the ear pad.

In an aspect of the present invention the plate has at least partially glass and is at least partially transparent.

In a further aspect of the present invention the drive system of the sound generator is provided in the ear pad.

According to the invention an ear cup of a headphone or earphone is formed from the plate and the ear pad.

In an aspect of the invention the headphone device has a frequency crossover to pass low frequencies to the drive system and high frequencies to the piezoelectric drive.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
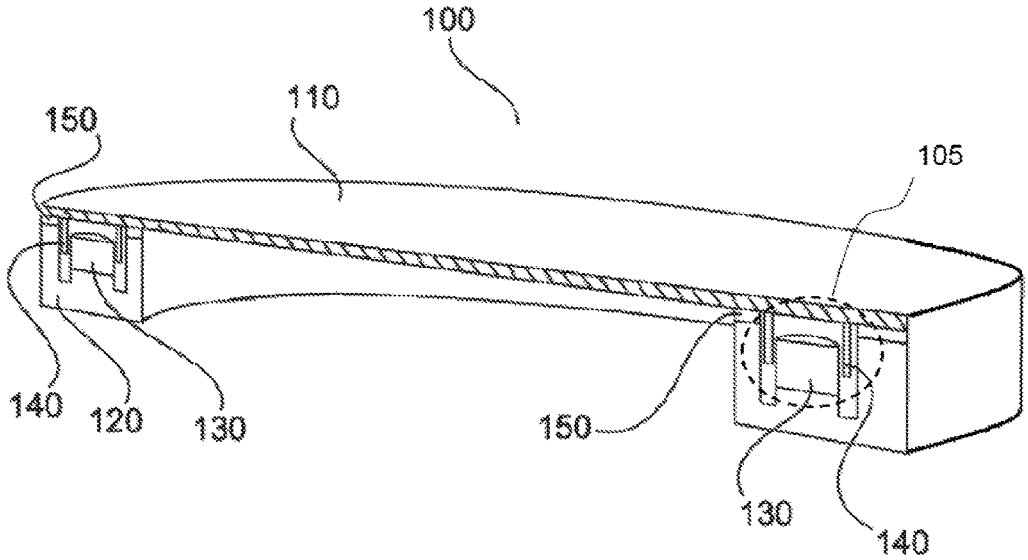
FIG. 1 shows a diagrammatic sectional view of a headphone device according to a first embodiment.

FIG. 1 shows a diagrammatic sectional view of a headphone device according to a first embodiment. The headphone device 100 has a plate 110 and a surrounding ear pad 120 connected directly or indirectly to the plate 110. The headphone device 100 according to the first embodiment is in the form of an electrodynamic headphone device and has a magnet system 130 as well as a voice coil 140 as the drive system 105.

Optionally a flexible portion 150 can be provided between the ear pad 120 and the plate 110. The voice coil 140 is coupled directly or indirectly to the plate 110 and excites the plate 110 to produce mechanical oscillations so that the plate 110 outputs an audio signal. The magnet system 130 and the voice coil 140 can be coupled by way of a cable within the ear pad to a feed cable of the headphone device, which in turn has a plug by way of which the audio signals to be reproduced can be received as electrical signals, wherein the audio signals are fed to the headphone device by way of the cable so that the audio signal can be reproduced by way of the drive system.

The provision of a flexible portion 150 between the ear pad 120 and the plate 110 is advantageous because that can increase the mobility of the plate 110 whereby improved sound delivery can be achieved.

According to the invention the plate 110 can be made from glass or another transparent material.

According to the first embodiment at least one electrodynamic drive having a magnet system 130 and a voice coil 140 is provided in the pad 120. According to the invention however more than just one electrodynamic drive can also be provided. According to the invention the plate 110 which for example is made of glass can emit for example a low-frequency sound (up to about 1 kHz). If the flexible portion 150 is provided between the ear pad 120 and the plate 110 the plate can also emit higher frequencies.

Figure 2:
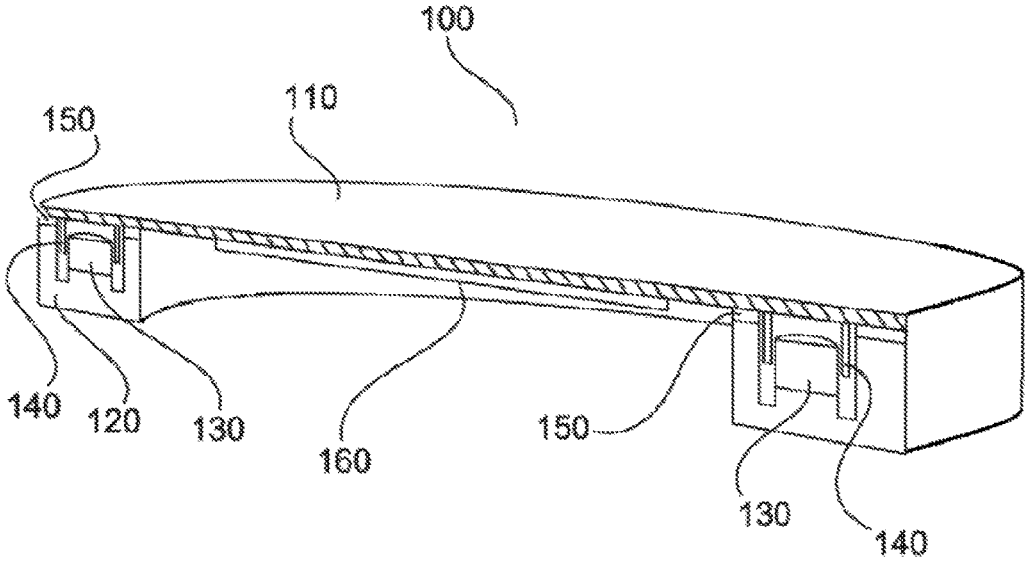
FIG. 2 shows a diagrammatic sectional view of a headphone device according to a second embodiment.

FIG. 2 shows a diagrammatic sectional view of a headphone device according to a second embodiment. The headphone device of the second embodiment substantially corresponds to the headphone device of the first embodiment. The difference between the headphone device of the first and second embodiments is that provided on the side of the plate 110, that is towards the ear, is a piezoelectric film 160 which can be actuated with the higher-frequency audio signals to deliver a higher-frequency audio signal. In that way the headphone device according to the second embodiment can be in the form of a two-way transducer, wherein the drive system (with the magnet system 130 and the voice coil 140) in the ear pad can deliver lower-frequency audio signals.

According to the invention the cables for the magnet system can optionally be laid within the ear pad.

According to the invention the plate 110 is optionally in the form of a glass plate. The piezoelectric film 160 can also optionally be transparent so that an ear of a user remains visible when wearing the headphone device according to the invention.

According to the invention the necessary cables can be integrated in the ear pad. That can be made possible for example by injection molding of the cable therein.

According to the invention the headphone device or the ear cup of a headphone device comprises only a (transparent) plate 110 and a surrounding ear pad 120 fitted thereto. The drive system for the plate 110 is provided in the ear pad 120. Thus only the plate and the ear pad are visible from the exterior.

The drive system 105 of a headphone device according to a third embodiment can be in the form of a capacitive drive system (with a counterpart electrode).

The headphone device according to the invention has a surrounding pad and a sound generator, wherein the sound generator has a substantially rigid plate and a drive system which is arranged in the ear pad. The plate lies on the ear pad.

According to a third embodiment the invention concerns a loudspeaker or sound generator having a rigid plate 110 and a drive system 105 for converting electrical signals into mechanical oscillations of the plate 110. Optionally a flexible portion or an elastic carrier or a flexible element 150 can be provided between the plate 110 and a fixing means of the plate. Thus according to the invention there is provided a sound transducer having a substantially rigid plate 110 and an at least partially surrounding drive system 105 for converting electrical signals into mechanical oscillations of the plate 110. According to the third embodiment the sound transducer has a corrugation which is coupled to a fixing means by way of an elastic carrier or a flexible holding unit.

Figure 3:
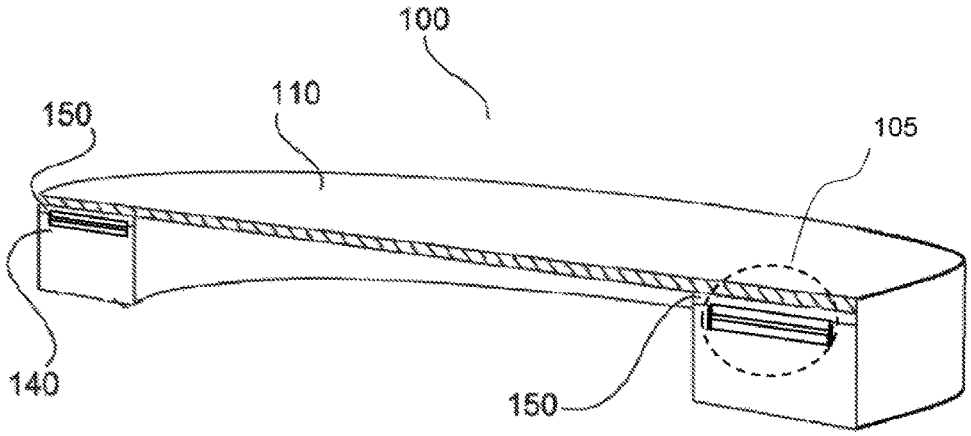
FIG. 3 shows a diagrammatic sectional view of a headphone device according to an embodiment of the present application.

FIG. 3 shows a diagrammatic view of a headphone device that has a capacitive drive system 105.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. A headphone device comprising:
an ear pad; and
a sound generator comprising:
a plate mounted on the ear pad;
a first drive system arranged in the ear pad and configured to convert electrical signals into mechanical oscillations of the plate; and
a piezoelectric film arranged on one side of the plate for exciting the plate.

2. The headphone device as set forth in claim 1, further comprising:
a frequency crossover configured to separate input signals into higher-frequency or lower-frequency signals;
wherein the higher-frequency signals are fed to the piezoelectric film and the lower- frequency signals are fed to the first drive system.

3. The headphone device as set forth in claim 1;
wherein the plate is formed from glass or a transparent material.

4. A headphone device comprising:
an ear pad; and
a sound generator comprising:
a plate mounted on the ear pad; and
a first drive system arranged in the ear pad and configured to convert electrical signals into mechanical oscillations of the plate,
wherein the first drive system comprises:
a magnet system; and
a voice coil;
wherein the voice coil is coupled to the plate.

5. The headphone device as set forth in claim 4;
wherein the first drive system comprises at least two magnets and, for each magnet, a coil that surrounds the magnet, and
wherein the magnets are arranged in the ear pad.

6. The headphone device as set forth in claim 5;
wherein the at least two magnets are arranged on opposite ends of the first drive system.

7. The headphone device according to claim 4;
wherein the plate is formed from glass or a transparent material.

8. A headphone device comprising
an ear pad; and
a sound generator comprising:
a plate mounted on the ear pad; and
a first drive system arranged in the ear pad and configured to convert electrical signals into mechanical oscillations of the plate,
wherein the first drive system directly excites a peripheral portion of the plate, and the first drive system does not directly excite a central portion of the plate.

9. The headphone device as set forth in claim 8;
wherein the central portion of the plate that is not directly excited by the first drive system includes a major area of the plate.

10. The headphone device as set forth in claim 8, further comprising:
a second drive system having a piezoelectric film,
wherein the piezoelectric film is arranged for exciting the central area of the plate.

* * * * *